US008961870B2

(12) United States Patent
Coleman et al.

(10) Patent No.: US 8,961,870 B2
(45) Date of Patent: Feb. 24, 2015

(54) ALUMINIUM LITHOGRAPHIC SHEET

(75) Inventors: Andrew Coleman, Llangyfelach (GB); David S. Wright, Rosdorf-Dramfeld (DE); Nicolas Kamp, Bovenden (DE); Jeremy Mark Brown, Athens (GR)

(73) Assignee: Novelis Inc., Atlanta, GA (US)

( * ) Notice: Subject to any disclaimer, the term of this patent is extended or adjusted under 35 U.S.C. 154(b) by 620 days.

(21) Appl. No.: 13/318,113

(22) PCT Filed: Mar. 22, 2010

(86) PCT No.: PCT/EP2010/053681
§ 371 (c)(1),
(2), (4) Date: Feb. 2, 2012

(87) PCT Pub. No.: WO2010/127903
PCT Pub. Date: Nov. 11, 2010

(65) Prior Publication Data

US 2012/0138481 A1 Jun. 7, 2012

(30) Foreign Application Priority Data

May 8, 2009 (EP) ..... 09159762

(51) Int. Cl.

| | |
|---|---|
| ***C22C 21/10*** | (2006.01) |
| ***C25F 3/04*** | (2006.01) |
| ***B41N 1/08*** | (2006.01) |
| ***B41N 3/03*** | (2006.01) |

(52) U.S. Cl.
CPC . *C22C 21/10* (2013.01); *C25F 3/04* (2013.01); *B41N 1/083* (2013.01); *B41N 3/034* (2013.01)
USPC ..... 420/540; 420/531; 420/532; 205/640

(58) Field of Classification Search
CPC ..... B41N 1/083; B41N 3/034; C22C 21/10; C25F 3/04
USPC ..... 205/640–686
See application file for complete search history.

(56) References Cited

U.S. PATENT DOCUMENTS

| | | | | |
|---|---|---|---|---|
| 4,360,401 | A | 11/1982 | Gray | |
| 4,802,935 | A | 2/1989 | Crona et al. | |
| 2002/0043168 | A1 * | 4/2002 | Mayers et al. | 101/395 |
| 2005/0013724 | A1 | 1/2005 | Ougi et al. | |
| 2008/0035488 | A1 | 2/2008 | Martin et al. | |

FOREIGN PATENT DOCUMENTS

| | | |
|---|---|---|
| CN | 1314254 | 9/2001 |
| EP | 1065071 | 1/2001 |

(Continued)

OTHER PUBLICATIONS

European Patent Application No. EP 10 709 557.2 , Office Action dated Oct. 29, 2013, 4 pages.

(Continued)

*Primary Examiner* — Nicholas A Smith
(74) *Attorney, Agent, or Firm* — Kilpatrick Townsend & Stockton, LLP

(57) ABSTRACT

The invention relates to an aluminum alloy lithographic sheet product having an enhanced electrolytic graining response in which Zn between 0.5 and 2.5 wt % is added to an aluminum base alloy, in particular an alloy of the 1XXX, 3XXX or 5XXX series alloys. The invention also relates to a method of producing a lithographic sheet product.

16 Claims, 6 Drawing Sheets

AA1050A with 1%Zn, electrograined for 10s at 15V

(56) References Cited

FOREIGN PATENT DOCUMENTS

| | | |
|---|---|---|
| EP | 1974912 | 10/2008 |
| JP | 62149856 | 7/1987 |
| WO | WO9222688 | 12/1992 |
| WO | WO9824571 | 6/1998 |
| WO | WO0248415 | 6/2002 |
| WO | WO03023079 | 3/2003 |
| WO | WO2004112992 | 12/2004 |
| WO | WO2007045676 | 4/2007 |
| WO | WO2007093605 | 8/2007 |
| WO | WO2009092412 | 7/2009 |
| WO | 2010127903 | 11/2010 |
| WO | 2012059362 | 5/2012 |

OTHER PUBLICATIONS

China Patent Application No. CN201080030515.6, Office Action dated Dec. 16, 2013, 10 pages.
Sato et al., "Mechanism of Activation of Aluminum By Low Melting Point Elements: Part 1—Effect of Zinc on Activation of Aluminum In Metastable Pitting", 9 pages, Dec. 1, 1998.
Sato et al., "Mechanism of Activation of Aluminum by Low Melting Point Elements: Part 2—Effect of Zinc on Activation of Aluminum in Pitting Corrosion", 7 pages, Jan. 1999.
Sanchez et al., "Electrograining of Aluminum in HCL: Effect of the Alloy for High Speed Processing Lines", 6 pages, Feb. 19, 2010.
English-language translation of Japan Patent Publication No. 62-149856, 16 pages, Jul. 3, 1987.
International Search Report for International Application No. PCT/EP2010/053681.
China Patent Application No. CN201080030515.6 , First Office Action dated Apr. 1, 2013, 9 pages.
European Patent Application No. EP 10 709 557.2 , Response to Office Action dated Aug. 27, 2013, 6 pages.
International Application No. PCT/EP2011/068614 , International Preliminary Report on Patentability dated May 7, 2013, 7 pages.
International Application No. PCT/EP2011/068614 , International Search Report & Written Opinion dated Nov. 18, 2011, 9 pages.
European Patent Application No. 10709557.2, European Examination Report mailed Apr. 18, 2013 (4 pages).
Chinese Patent Application No. CN 2014072901266340, Third Office Action mailed Aug. 1, 2014, 8 pages.

* cited by examiner

Figure 1: Schematic of the a.c. wave form in nitric acid
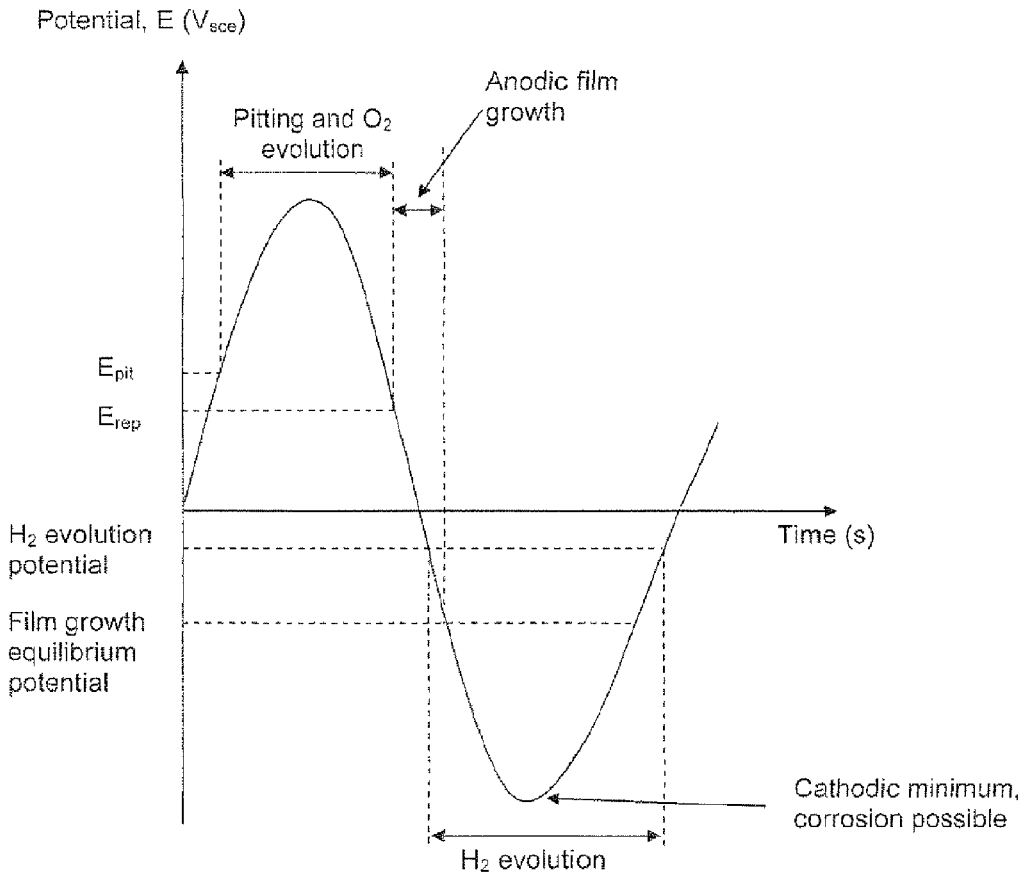

Figure 2: Schematic of a.c. wave form in pure hydrochloric acid
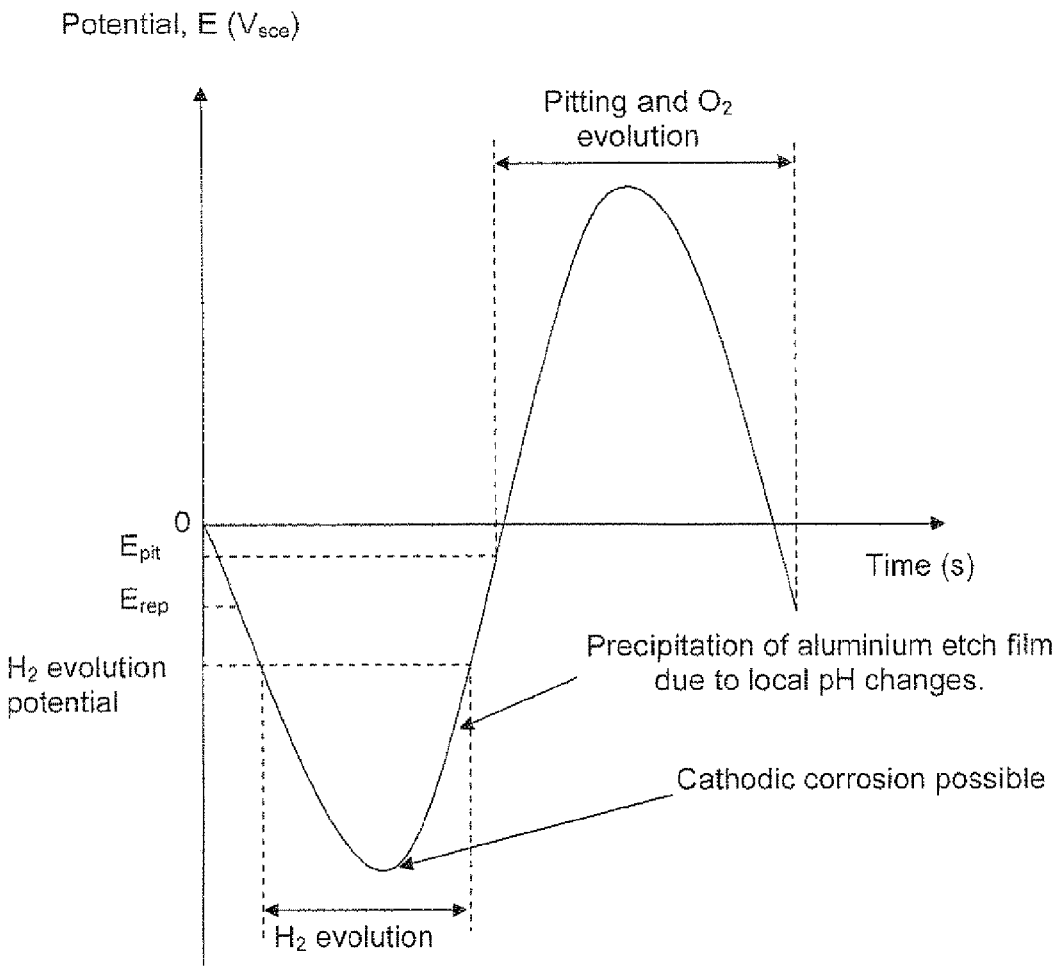

Figure 3: Reference commercial material AA1050A electrograined for 15s at 15V
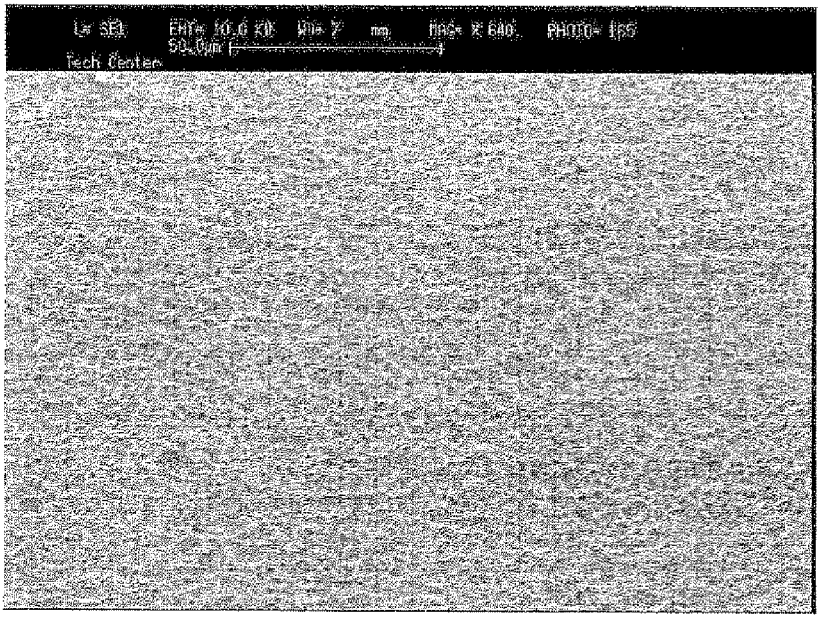
Figure 4: AA1050A with 1%Zn, electrograined for 10s at 15V
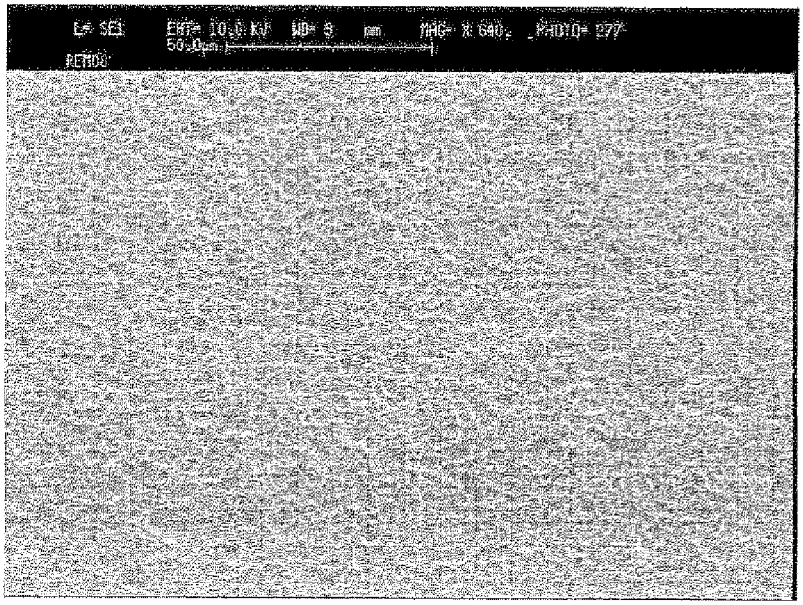

Figure 5: the decrease in the percentage area of the surface that consists of plateau with increasing electrograining time for a commercial AA1050A product electrograined at 15V for different durations
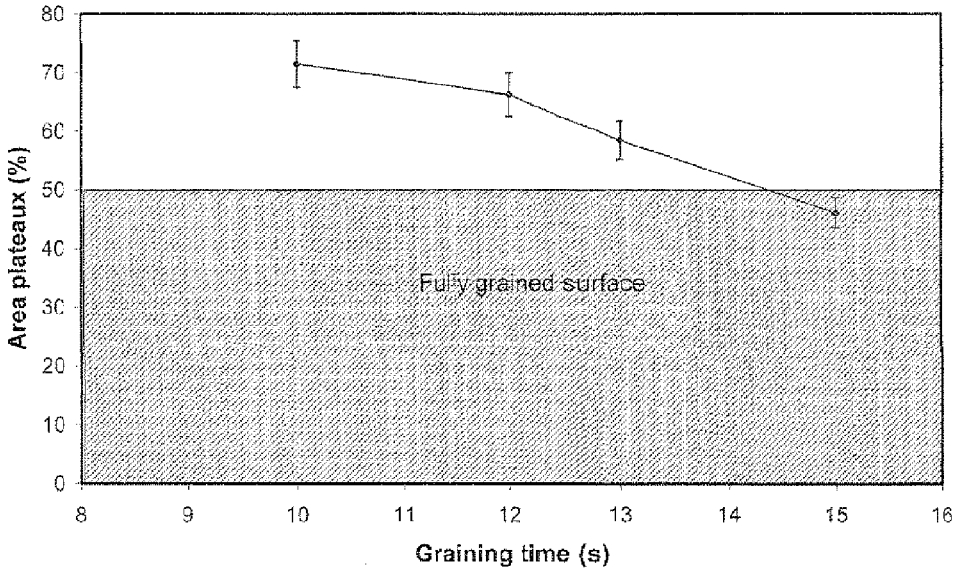
Figure 6: time taken and charge density used to obtain a fully grained surface at a constant voltage (15V) for various Zn additions to AA1050A
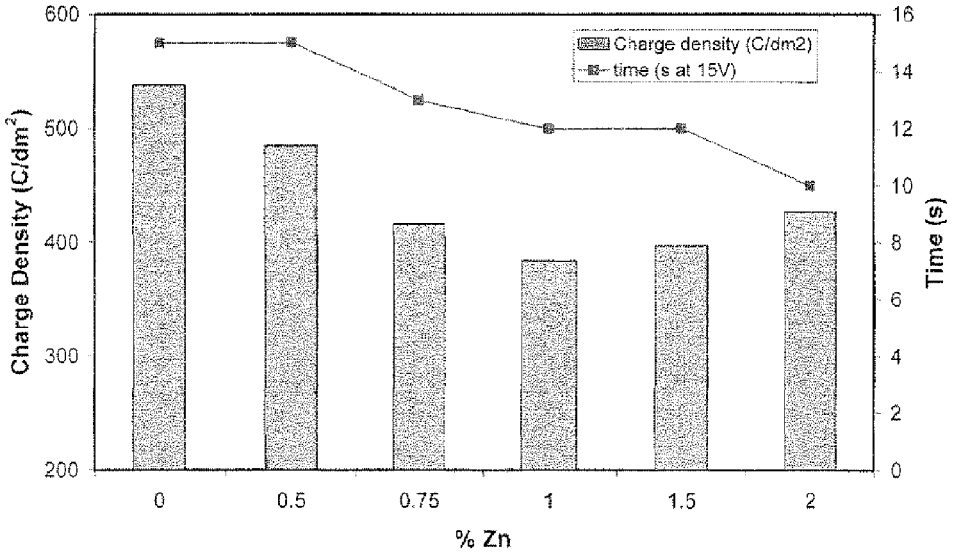

Figure 7: surface topography of an AA1050A alloy with 2.75%Zn after electrograining at 15V for 10s showing undesirable localized surface attack
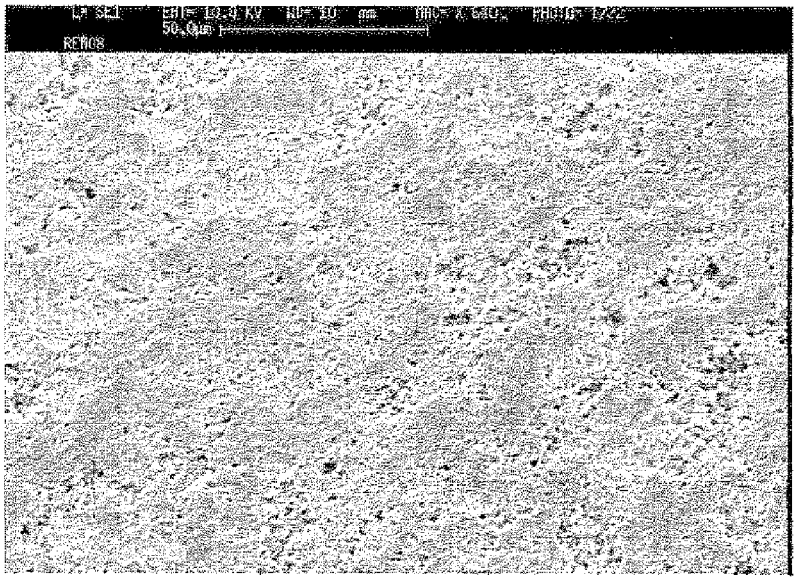
Figure 8: AA3103 after electrograining for 15s at 15V
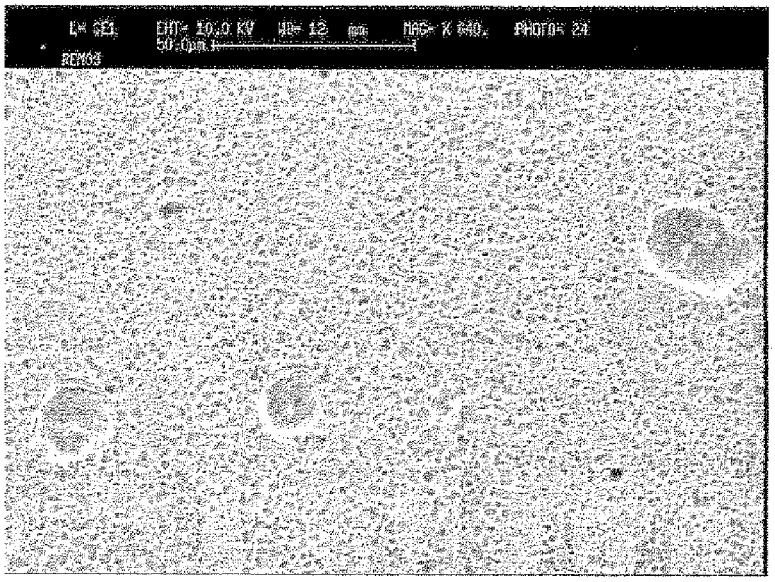

Figure 9: AA3103 with 0.75wt% Zn after electrograining for 15s at 15V
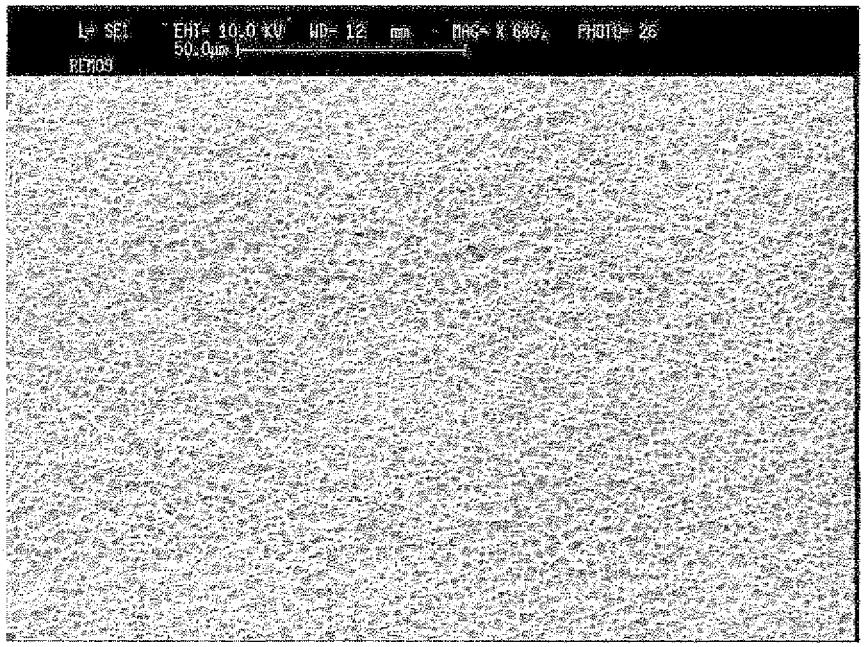

ALUMINIUM LITHOGRAPHIC SHEET

PRIOR RELATED APPLICATIONS

This application is a National Phase application of International Application No. PCT/EP2010/053681 filed Mar. 22, 2010, which claims priority to European Application No. 09159762.5 filed May 8, 2009, each of which is incorporated herein by reference in its entirety.

The present invention relates to an aluminium alloy lithographic sheet product. In particular it relates to an alloy composition designed to promote enhanced electrolytic roughening. The invention also relates to a method of making an aluminium lithographic sheet substrate.

In the production of aluminium lithographic plates, the surface of the rolled aluminium sheet is usually cleaned, then roughened, (alternatively called "graining"), anodized to provide a hard, durable oxide layer, and then coated with an oleophilic layer prior to use in the printing operation.

Surface roughening can be achieved by chemical, mechanical or electrochemical techniques, or a combination of each, many of which are well established or documented in the industry. The roughening process is necessary to control the adhesion of the oleophilic coating on the support plate and to control the water retention properties of the uncoated surface.

Electrochemical roughening, also known as electrolytic roughening and hereinafter as electrograining has been in use for many years. It is the predominant commercial method for roughening the surface of aluminium lithographic sheet. In this process the sheet of aluminium is initially cleaned, typically in caustic soda, and then passed continuously through a bath of a conducting electrolyte.

Electrograining is an alternating current (a.c.) process. Various cell configurations are used industrially but in essence all comprise the sheet passing parallel sequentially to counter electrodes that are connected to the a.c. power supply. Thus current flows from one or more electrodes that are connected to one side of the power supply through the electrolyte to the sheet, passes along the sheet and thence again via the electrolyte to a second electrode or set of electrodes. This is called the Liquid contact method as no direct contact is made between the sheet and the power supply.

Commercial electrograining is carried out in either nitric or hydrochloric acid. These acids are usually at a concentration of between 1% and 3%. Below this range the conductivity is too low to pass sufficient current in a reasonable time and above this range graining is generally non-uniform both on a microscopic scale and across the width of the sheet due to uneven current distribution. Additions such as acetic acid, boric acid, sulphates, etc. are often made to these electrolytes to modify the graining behaviour.

The electrograining process produces a surface that is characterised by numerous pits. The size and distribution of the pits varies and is dependent upon a wide range of factors, including but not limited to the alloy composition, metallographic structure, electrolyte, the electrolyte concentration, temperature, voltage applied and the profile of the applied voltage wave form.

Most recently lithographic plate customers desire flat plate topographies with the roughening step producing finer pit sizes with an increased uniformity of pit size.

The a.c. wave form, or the curve of the voltage/time plot during electrograining, is generally sinusoidal in shape, although it is common for the shape to be biased in the anodic direction. The sheet potential is positive in the anodic portion of the cycle and negative in the cathodic portion. FIGS. 1 and 2 illustrate the nature of an a.c. wave form in nitric and hydrochloric acids respectively.

In order to initiate a new pit and enable its growth a certain voltage has to be exceeded. This voltage limit is known as the pitting potential, or $E_{pit}$. There is a second voltage limit to consider, known as the repassivation potential, $E_{rep}$. This potential limit is below $E_{pit}$ and signifies the point at which repassivation takes place. Repassivation is caused by the formation of an oxide film on the active pits, so that the normal condition of aluminium is re-established, i.e. the surface is covered with an oxide film.

After the voltage passes through the cathodic minimum it then starts to become less negative. Once the voltage increases above the pitting potential pits initiate and sustained growth ensues. These pit sites may either be new or ones that have been active during the previous cycle. Pitting continues throughout the period that the voltage is above the pitting potential but stops as soon as the voltage drops below the repassivation potential again.

In pure hydrochloric acid electrolytes the pitting and repassivation potentials are at negative values; they lie in the cathodic regime. In other electrolytes, such as pure nitric acid or hydrochloric acid plus acetic acid these potentials are positive so they lie in the anodic region of the waveform. In these cases when the voltage is anodic, but below the pitting potential, anodizing occurs.

A further mechanism that occurs in the cathodic cycle is that the surface can become sensitized at local points. These sensitized points are effectively flaws in the protective oxide film that become potential pit site locations once the voltage passes back above the pitting potential. In nitric acid it has been shown that these sites occur where the junctions of sub-grains meet the oxide film at the metal/oxide interface. For hydrochloric acid, these sites occur when chloride ion penetrates the overlying oxide film.

For a given wave form the duration of pitting initiation and growth and the duration of repassivation depend on the values of the pitting and repassivation potentials respectively. As the voltage, or the sheet potential, changes and rises above the pitting potential new pits may be formed or those created in the first cycle may be subject to further growth. The balance between pit growth and pit initiation depends upon the prevailing process conditions. Although this is a relatively random process on a pit-by-pit scale, a longer duration in the repassivation portion will tend to encourage the sensitisation of potential new pit sites in the cathodic cycle and provide more time for existing pits to repassivate. Generally, finer, more uniform pitted surfaces are found when electrograining in electrolytes where the pitting and repassivation potentials are increased, (i.e. more positive), for instance in nitric acid or by the addition of additives such as sulphate or acetic acid to a hydrochloric acid electrolyte.

Therefore, the process by which electrograining proceeds is a competition between initiation, repassivation and growth. To deliver the desired functionality, the final roughened plate topography must have the correct size distribution of pits, uniformly arranged over the plate surface. Most recently, lithographic plate customers desire flat plate topographies with the roughening step producing finer pit sizes with an increased uniformity of pit size. Too much pitting or too large and too deep pits will give a surface that is too rough and cause plate development and print resolution problems. Too little pitting will result in poor polymer adhesion and reduced print run length. According to this analysis, an alloy with low pitting potential and low repassivation potential would promote a coarser pitted structure.

It also remains of interest to those carrying out electrograining to be able to increase the speed of the operation, reduce energy costs and reduce the environmental impact of their operations. A faster operation may translate into shorter bath lengths. Alternatively, faster treatment times translate into smaller charge inputs for the same bath length or a reduction in the voltage necessary to deliver the required charge. In either case energy savings can be realised. A reduction in the amount of electrolyte necessary may be achieved if fewer coulombs are used since the quantity of electrolyte used is related to the amount of dissolved aluminium that requires removal. A lower charge density translates to less aluminium dissolved in solution and less recycling of electrolyte. A smaller quantity of electrolyte, in turn, provides environmental benefits.

EP-A-1425430 describes an aluminium alloy for use as a lithographic sheet product wherein the alloy composition contains a small addition of zinc (Zn) up to 0.15%, preferably from 0.013-0.05%. This addition of Zn is intended to mitigate the harmful effects of increasing impurity content, in particular V. The electrograining examples were carried out in nitric acid.

EP-A-0589996 describes the use of a number of elements for promoting the electrograining response of lithographic sheet alloys. The elements described are Hg, Ga, In, Sn, Bi, Tl, Cd, Pb, Zn and Sb. The content of the added element is from 0.01-0.5%. The preferred content of these added elements is 0.01 to 0.1% and specific examples are given where the Zn content is 0.026 and 0.058 and 0.100%. Although this document suggests the use of these elements will provide an enhanced graining response in hydrochloric acid as well as nitric, all the examples were performed with nitric or nitric plus boric acid.

U.S. Pat. No. 4,802,935 describes a lithographic sheet product where the production route starts with the provision of a continuous cast sheet. The composition of the alloy has Fe from 1.1-1.8%, Si 0.1-0.4% and Mn 0.25-0.6%. Zn is mentioned as an optional extra up to 2% but no examples of such an alloy are given.

JP-A-62-149856 describes the possibility of using age-hardenabie alloys based on one of the Al—Cu, Al—Mg—Si and Al—Zn—Mg alloy systems for use as lithographic sheet. The Al—Zn—Mg alloy is an alloy containing 1-8% Zn and 0.2-4% Mg. The only example of this alloy system is an alloy with 3.2% Zn and 1.5% Mg. This alloy also contains 0.21% Cr. The focus of this document is the improvement of the resistance to softening that occurs during the staving treatment and there is no indication of the effect of such elements on the electrograining response.

US-A-20050013724 describes an alloy for use as lithographic sheet where the composition is selected within the following ranges: Fe 0.2-0.6%, Si 0.03-0.15%, Mg 0.1-0.3% and Zn 0.05-0.5%. An alloy with Zn at 0.70% was electrograined in 2% hydrochloric acid at a temperature of 25° C., with a current density of 60 A/dm$^2$ for 20 seconds. The current density level was the same for all samples tested. Current density is not the same as charge density but the charge density can be easily calculated because it is simply the multiple of current density and duration of treatment, which gives a total charge density of 1200 C/dm$^2$. The authors describe the alloy with 0.70% Zn as having a coarse pit structure with some regions remaining unetched. There is no suggestion that an alloy with a Zn content of 0.70% could be satisfactorily electrograined or of the conditions to be used to achieve a fully-grained surface. This document teaches that an upper limit of 0.5% Zn should be observed to prevent coarse pits and non-uniform roughening.

An article by Sato and Newman, "Mechanism of Activation of Aluminum by Low-melting Point Elements: Part 2—Effect of Zinc on Activation of Aluminum in Pitting Corrosion", in Corrosion, Vol. 55, No. 1, 1999, describes the effect of Zn additions on the pitting potential and repassivation potential. The material used in these experiments was a binary alloy where the aluminium was 99.999% to which various Zn additions were made. The sheet material used in the tests was also fully annealed, a very soft condition that is inappropriate for use in lithographic sheet. The figures included within the article illustrate that the behaviour of the alloy is the same for all Zn additions and that an increase in Zn content lowers both the pitting and repassivation potentials. As mentioned above, this would lead to the conclusion that more time is available for pitting initiation and growth and less time for repassivation during the a.c. cycle, leading in turn to a surface having fewer but larger pits and thus a rougher and coarser surface after treatment. Indeed, the article states that activation leads to profuse surface roughening.

The caustic soda cleaning step is an etching process and additions of Zn have been found to cause a "spangling" effect, a variable etching response across the grain structure of the sheet substrate. Since the objective in lithographic sheet production is to generate a uniform surface, such variations would be undesirable and this is another deterrent to the addition of high Zn amounts in an alloy for lithographic sheet.

It is an object of this invention to provide an aluminium alloy for use in lithographic sheet which has an enhanced electrograining response, thereby permitting faster treatment times.

It is a further object of this invention to provide an aluminium alloy for use in lithographic sheet which, after roughening, provides a fine and uniform pit size distribution.

In contrast to the prior art mentioned above the inventors have found that an addition of higher Zn contents to various base alloys of aluminium leads to an improvement in the electrograining response, especially in electrolytes containing HCl, which translates into significant efficiencies of operation for companies involved in electrograining aluminium sheet.

According to a first aspect of the invention there is provided an aluminium alloy lithographic sheet product having a composition comprising:

a base alloy of aluminium and 0.5-2.5% Zn.

According to a second aspect of the present invention there is provided a method of making a lithographic sheet alloy which comprises the step of adding from 0.5 to 2.5% Zn to a base alloy of aluminium.

According to a third aspect of the present invention, the step of adding from 0.5 to 2.5% Zn to a base alloy of aluminium is used to enhance the electrograining response in the manufacture of lithographic sheet.

All Zn contents and that of other elements mentioned herein are in weight %.

Within the context of this invention, the term "base alloy" is intended to include alloy compositions exemplified by the "International Alloy Designations and Chemical Composition Limits for Wrought Aluminum and Wrought Aluminum Alloys", published by The Aluminum Association and revised, for example, in April 2004. This registration record is recognized by national aluminium federations or institutions around the world. In particular within this invention the term base alloy is intended to cover aluminium alloy compositions based on the 1XXX, 3XXX and 5XXX series of alloys, each of which is described below in more detail. Usually, and as explained in the above registration record, small amounts of "other elements" are present in all commercial alloys of aluminium. The term base alloy is, therefore, also intended to cover the main alloying elements and any trace elements or impurities that would typically be present in such alloys.

The above registration record of alloy compositions is not comprehensive because there are many other known alloy compositions which have not been subject to applications for registration. Within the scope of this invention the term "base alloy" is also intended to cover such unregistered alloys which by virtue of their composition would be considered as 1XXX, 3XXX or 5XXX series alloys if they had been put forward for registration. A few examples of such alloys are given below.

The 1XXX series of alloys covers aluminium compositions where the aluminium content is ≥99.00% by weight. The 1XXX series is normally considered to fall into two categories. One category relates to wrought unalloyed aluminium having natural impurity limits. Common alloys include compositions known as AA1050 or AA1050A but this group also includes super-pure compositions such as AA1090 and AA1098 where the aluminium content is at least 99.9 weight %. The second category covers alloys where there is special control of one or more impurities. For this category the alloy designation includes a second numeral that is not zero, such as AA1100, AA1145, and so on.

Alloys of AA1050 or AA1050A are the main 1XXX series alloys used in lithographic sheet as unclad monolithic sheet materials. Alternatively, alloys based on the 1XXX series but with small additions of elements such as magnesium, manganese, iron or silicon may be used. Another element that has been deliberately added includes vanadium. The addition of controlled quantities of these and other elements, alone or in combination, has usually been made with a view to enhancing a particular property such as yield strength after stoving, fatigue resistance, or in an attempt to make the surface more responsive to the various treatment steps.

Further, classification of alloy compositions is not completely precise and there are a number of compositions mentioned in prior art publications which do not conveniently fall within a particular class. Although 1XXX series alloys are generally considered to have >99.00% aluminium, for the purpose of this invention, compositions described by the following patent specifications are also considered as 1XXX series alloys: EP-A-1065071, WO-A-07/093605, WO-A-07/045676, US-A-20080035488, EP-A-1341942 and EP-A-589996. Most, if not all, of these compositions have not been registered with the Aluminum Association but are known to those in the lithographic sheet industry, particularly the alloys described within EP-A-1065071 and EP-A-1341942.

The 3XXX series of alloys are those where Mn is the main alloying addition. Of the 3XXX series alloys, the most common alloy for use as lithographic sheet is the alloy 3103, although the alloy 3003 may also be used. Again, various other 3XXX series type alloys have been developed with special alloying additions or combinations, essentially for the same reasons as mentioned above, and the definition of 3XXX series alloys according to this invention is intended to cover alloys which, by virtue of their Mn content would be considered as a 3XXX series alloy if they had been submitted for registration. In contrast to the 1XXX series alloys the mechanical properties of 3XXX series alloys are higher but there are often problems during surface treatment operations due to the presence of Mn or Mg rich intermetallic phases at or near the surface. A preferred 3XXX series alloy within this invention is AA3103.

The 5XXX series of alloys are those where Mg is the main alloying addition. 5XXX series alloys are not generally known for use as lithographic sheet because of the influence of Mg or Mn intermetallics at or near the surface which can affect surface preparation. Again, various other 5XXX series type alloys have been developed with special alloying additions or combinations, essentially for the same reasons as mentioned above, and the definition of 5XXX series alloys according to this invention is intended to cover alloys which, by virtue of their Mg content would be considered as a 5XXX series alloy if they had been submitted for registration. Like the 3XXX series alloys the mechanical properties of 5XXX series alloys are higher than the 1XXX series alloys due to work hardening and solute strengthening. A preferred 5XXX series alloy within this invention is AA5005.

For the 3XXX and 5XXX series alloys the inventors have found that an addition of Zn in the quantities claimed mitigates the effect of the Mn or Mg rich intermetallics during surface preparation and provides an enhanced electrograining response.

The inventors have found that, when the Zn content is below 0.5%, there is no significant benefit in electrograining response, particularly in an electrolyte containing HCl. When the Zn content was 2.75%, i.e. above 2.5%, the surface tended to overgrain or form coarse and undesirable pits. For these reasons the Zn range is selected to be 0.5 to 2.5%. An improvement in the electrograining response was found with increasing Zn contents above the lower of these two limits. Therefore a first alternative lower limit for the Zn content is >0.5% and another alternative lower limit for Zn is 0.71%. An alternative upper limit for the Zn content is 2.0%. An alternative range for the Zn content is 0.71 to 2.0%. Even better electrograining performance was achieved with Zn contents at 1% or 1.5%. Therefore an alternative lower limit for the Zn content is 0.9% and an alternative upper limit for the Zn content is 1.75%. An alternative range for the Zn content is 0.9 to 1.75%.

Although the lithographic sheet alloy according to the invention can be used in a monolithic form, it may also be used as a surface clad layer on a composite product comprising a core of a different alloy composition. In such circumstances the core alloy could be selected from those core alloys described within European patent application EP-A-08009708, the disclosure of which is incorporated herein by reference.

In order to manufacture the lithographic sheet product according to the invention various well-established industrial methods may be used. For example, molten metal of the correct composition may be cast using semi-continuous Direct Chill (DC) casting methods, or it may be cast in a continuous manner using twin roll casters or a belt caster.

In the case of the DC method, the cast ingot is scalped and this may be followed by homogenization or a heat-to-roll practice. The homogenization temperature is between 450-610° C. and its duration is from 1-48 hrs. Homogenization may occur in more than one step. The heat-to-roll practice usually involves heating the scalped ingot to the temperature at which hot rolling commences but it may also involve heating the ingot to a temperature above the start temperature of hot rolling and then cooling the ingot down to the start of hot rolling. Hot rolling takes place between 540 and 220° C. Cold rolling is then carried out with or without interannealing. The final gauge of the sheet product is between 0.1 mm and 0.5 mm. Typically hot and cold rolling reductions will lie between 1 and 70%.

In the case of a continuous cast sheet, there may be a homogenization or heat-to-roll step before hot rolling but typically the hot cast sheet would be taken for hot rolling before substantial cooling has occurred. As with a DC version, hot rolling is followed by cold rolling to final gauge, with optional annealing steps as appropriate.

When the alloy of the invention is used as a clad layer in a composite product the complete product can be fabricated by conventional methods known to those in the aluminium industry. For example, the product can be made by a traditional roll bonding approach where the core layer and clad layers are initially cast as separate ingots, homogenized and hot rolled to an intermediate thickness, then hot or cold rolled together to form the composite structure, followed by further rolling as necessary. As is known to the skilled person, various heat treatment steps may be incorporated within this process if necessary, such as intermediate anneals. An alternative method of manufacture involves casting the core and clad layers together to form a single ingot having distinct compositional regions. Such methods are also well known in the aluminium industry and are described by patents such as WO-A-04/112992 or WO-A-98/24571. The process according to WO-A-04/112992 is better suited to manufacture of the composite product because there is no need for an interlayer during casting and problems encountered in roll bonding are avoided. Once the composite ingot has been cast it can be processed in the conventional manner and process steps may include homogenization, hot and cold rolling, together with other standard manufacturing steps as deemed necessary by the skilled person.

According to a further aspect of the invention there is provided a method of producing a lithographic sheet comprising the following steps:

providing a sheet product with the following composition 0.5-2.5% Zn added to a base alloy of aluminium electrograining in an acidic electrolyte with a total charge density ≤500 C/dm$^2$.

A preferred version of the method of this invention uses a total charge density ≤490 C/dm$^2$ and a more preferred version of the method of this invention uses a total charge density ≤450 C/dm$^2$.

Further preferred versions of the method of the invention use specific alloy compositions to which dependent claims 2 to 13 are directed. In one embodiment of the method of this invention, the electrolyte contains hydrochloric acid. In another embodiment of the method of this invention the electrolyte contains hydrochloric acid and sulphates.(*) In a further embodiment of the method of this invention the electrolyte contains nitric acid.

(*) In another embodiment of the method of this invention the electrolyte contains hydrochloric acid and acetic acid.

The invention is illustrated by way of the following examples and figures.

FIG. 1 is a schematic of an a.c. wave form in nitric acid.

FIG. 2 is a schematic of an a.c. wave form in pure hydrochloric acid.

FIG. 3 illustrates the surface topography of a commercially produced AA1050A lithographic sheet after electrograining and serves as a reference example.

FIG. 4 shows the surface topography of a lithographic sheet according to the invention containing approximately 1% Zn after electrograining for a reduced period of time.

FIG. 5 shows the decrease in the percentage area of the surface that consists of plateau with increasing electrograining time for a commercial AA1050A product electrograined at 15V for various durations.

FIG. 6 shows the time taken and charge density used to obtain a fully grained surface at a constant voltage (15V) for various Zn additions to AA1050A.

FIG. 7 is a picture of an AA1050A alloy containing 2.75% Zn showing undesirable localized surface attack after electrograining.

FIG. 8 is a picture of an AA3103 alloy without an addition of Zn after electrograining at 15V for 15 s.

FIG. 9 is a picture of an AA3103 alloy containing an addition of 0.75% Zn after electrograining at 15V for 15 s.

EXAMPLE 1

Alloys based on AA1050A with varying Zn content were prepared for electrograining. The main elements present are shown in Table 1; other elements were below 0.05% each and below 0.15% total. The balance was aluminium.

TABLE 1

| Sample ID | Base alloy + nominal Zn (%) | Si_(%) | Fe_(%) | Zn_(%) |
|---|---|---|---|---|
| A | AA1050A | 0.076 | 0.28 | 0.0017 |
| 1 | AA1050A + 0.1Zn | 0.08 | 0.30 | 0.100 |
| 2 | AA1050A + 0.2Zn | 0.08 | 0.30 | 0.200 |
| 3 | AA1050A + 1Zn | 0.07 | 0.30 | 0.990 |
| 4 | AA1050A + 5Zn | 0.08 | 0.34 | 4.950 |

Sample A is a reference alloy. All alloy variants were produced as sheet 0.25 mm thick in the H19 temper. The processing conditions were:

DC cast in a mould with a cross-section measuring 95 mm×228 mm scalped homogenized by heating to 520° C. over 8 hrs, followed by holding at 520° C. for between 4.5-6 hrs hot rolled to a gauge of 2.0 mm cold rolled to 0.25 mm Each sheet was cleaned with ethanol and sample discs were taken for electrograining studies in a laboratory cell unit.

Prior to electrograining, samples were precleaned in a 3 g/l NaOH solution at 60° C. for 10 secs and rinsed in de-ionised water. Following electrograining, the samples were de-smutted in a 60° C. 150 g/l $H_2SO_4$ electrolyte for 30 secs before rinsing in de-ionised water and drying in an argon gas stream.

The cell unit compromises two half cells each having an aluminium electrode and a graphite counter electrode, operated in the liquid contact mode. The cell unit was used for electrograining discs of each alloy in a fixed time or fixed voltage mode and all experiments were performed at an electrolyte temperature of 40° C. The electrograining electrolyte was that described by EP-A-1974912 and constituted 15 g/l HCl+15 g/l $SO_4^{2-}$+5 g/l $Al^{3+}$. The electrolyte flow rate through the cell was 3.3 l/min.

Following initial visual examination of the electrograined surfaces all samples were further characterised using a Stereoscan 360FE Scanning Electron Microscope (SEM). A commercially produced and electrograined AA1050A lithographic plate material was chosen as a reference material. The surface topography demonstrated with this commercially produced sample is shown in FIG. 3 after electrograining in the cell unit at 15V for 15 s with a resulting charge density of ~520 C/dm$^2$. This is the benchmark against which the other electrograining responses were measured.

All samples were examined for evidence of a uniformly fine pit structure developed either at shorter graining times or at lower voltages than sample A as well as the amount of plateau and directionality.

Under these particular electrograining conditions samples 1 and 2 did not provide any significant change or benefit compared with sample A.

The electrograining response at 10V and duration of 10 s was analysed as a function of increasing Zn content for samples 1, 3 and 4. At this low graining voltage, the addition of 1.0% Zn provided a benefit in the formation of fine uniform pit structure compared with the lowest Zn addition of 0.1%. However, the high Zn alloy, sample 5, led to an aggressively corroded surface.

At a graining voltage of 15V, the 1% Zn alloy gave the desired fine pit structure after only 10 s graining time, see FIG. 4. The surface topography obtained under these conditions was comparable with the reference commercial plate material shown in FIG. 3. This can be translated into a significant increase in electrograining performance, i.e. it would translate to ~33% increase in line speed.

EXAMPLE 2

A new set of alloys based on AA1050A with varying Zn content were prepared for electrograining. The main elements present are shown in Table 2. Other elements were below 0.05 wt % each and below 0.15 wt % total. The balance was aluminium. Sample B is intended as a reference example.

TABLE 2

| Sample ID | Base alloy + nominal Zn (%) | Si_(%) | Fe_(%) | Zn_(%) |
|---|---|---|---|---|
| B | AA1050A | 0.07 | 0.27 | 0.003 |
| 6 | AA1050A + 0.5Zn | 0.07 | 0.28 | 0.49 |
| 7 | A1050A + 0.75Zn | 0.07 | 0.30 | 0.74 |
| 8 | AA1050A + 1Zn | 0.07 | 0.32 | 1.02 |
| 9 | AA1050A + 1.5Zn | 0.08 | 0.29 | 1.48 |
| 10 | AA1050A + 2Zn | 0.08 | 0.30 | 2.02 |
| 11 | AA1050A + 2.75Zn | 0.07 | 0.31 | 2.74 |
| 12 | AA1050A + 3.5Zn | 0.07 | 0.31 | 3.43 |
| 13 | AA1050A + 4.3Zn | 0.07 | 0.32 | 4.29 |

All of these samples were produced using the same process route as described in Example 1 except that an interanneal was used when the sheet was 2 mm thick, the interanneal involving a 2 hr heat up to 450° C., 2 hrs at that temperature and a cool down to start of cold rolling. In other words, the sheet material was provided in the H18 condition instead of H19.

As with Example 1, each sample was cleaned in caustic soda solution and electrograined using the same electrolyte, same flow rate and same post-graining clean/desmutting conditions. The same analysis technique was used to compare surface topographies.

To quantitatively measure how the graining topography develops, the SEM images were measured using a standard stereology technique, (see Russ, J. C. "Practical Stereology", Plenum Press, 1985). An image analysis software package (Zeiss KS400) was used to aid the efficiency of this method, which uses a point counting technique to estimate the fraction of surface electrograined. The surface is defined as consisting of either pits (electrograined) or plateaux (not grained). A grid of equally spaced points, (Ntot), is randomly positioned on the image. The number of points (Npit) lying within a pit is counted (points lying on the boundary between pit and plateaux are counted as ½). The area fraction of grained surface is then equal to Npit/Ntot.

To establish a benchmark for a fully grained surface, the topography of alloy B under various efectrograining conditions was analysed using the above method. FIG. 5 shows the measured area fraction of plateaux as a function of graining time at 15V for various electrograining durations for this sample. The sample electrograined for 15 s and 15V was assessed visually (from the SEM images) to be fully electrograined. From this it was established that a fully grained surface is considered as one where Npit/Ntot is >0.5, (i.e. where the number of plateau as a proportion of the total is below 50%). This method of measurement was used in conjunction with visual assessment of all the samples to compare the degree of electrograining achieved for the different alloy variants over a range of conditions.

In the following summary of the electrograining response of these Al—Zn alloys two scenarios are considered. Firstly a constant voltage was used to investigate the time needed to achieve a fully grained surface as a function of zinc content before deterioration in the surface morphology of the alloys is observed. The second scenario considers a situation where the time for graining is kept constant but the voltage required to generate a fully grained surface was changed.

According to the first scenario, each alloy was electrograined in the cell unit for durations ranging from 10 to 15 s at 15V. Visual inspection of the surface morphology of every alloy following electrograining at 10, 11, 12, 13 and 15 s was then performed and compared to the reference sample B. Visual inspection concluded that alloys 6, 7, 8, 9 and 10 were fully grained in 15, 13, 12, 12 and 10 s respectively. Measurement of the surface morphology of these samples using the KS400 software was used to check the visual assessment. Table 3 shows the ratio, expressed as a percentage, of Npit/Ntot, for 5 samples, electrograined at 15V.

TABLE 3

| Sample | Duration of electrograining, (s) | Ratio of Npit/Ntot (%) |
|---|---|---|
| 6 | 15 | 50.65 |
| 7 | 13 | 55.19 |
| 8 | 12 | 55.84 |
| 9 | 12 | 55.84 |
| 10 | 10 | 52.6 |

FIG. 6 shows a plot of the time taken to obtain a fully grained surface with the corresponding charge density. These both decrease with increasing zinc content up to a level of 2 wt % when electrograining at 15V. As with Example 1, these results would translate to significant improvements in electrograining response and significant improvements in operating efficiency. The switch to improved electrograining response under this scenario appears to be somewhere between 0.5% and 0.75% Zn and hence, in accordance with the general scope of the invention the lower limit for Zn can be established as >0.5%.

For levels of zinc in the range 2.75-5 wt % the electrograining response changed. Large, deep, localised corrosion sites on the surface were observed. These larger corrosion pits are suggestive of a scenario where the surface is unable to fully repassivate in the cathodic cycle and thus all the anodic activity is concentrated in the same locations without the general pitting of the surface that is normally observed during electrograining.

The second scenario considered a situation that is more likely to be of benefit to plate producers who may have problems increasing their line speeds because of the mechanics involved. This time the samples were electrograined over a range of voltages from 10-15V for a constant duration of 15 s. The SEM images for each alloy and each voltage condition were visually compared with the surface topography of the reference sample B and the condition identified where each sample was first considered to be fully electrograined. This corresponded to a value of 14, 14, 12 and 10V being required for samples 6, 7, 8 and 9 respectively. Alloy sample 10 containing 2 wt % zinc was considered to be overgrained when treated at 15V for 15 s, the pit structure becoming coarser. At voltages below 10V, for alloys 6, 7, 8 and 9 there was no significant roughening of the surface, which is the same for sample B. For sample 10, below 15V, whilst dissolution occurred the roughening was not that desired for litho plate because the roughening consisted of localised and coarse pits.

The following Tables, 4 to 8, summarise the complete results for samples 6 to 10. The ranking of the grained surface is given by the numerical values 1 to 5, where in all cases the reference for comparison was sample B electrograined under the same conditions. For clarity, if the inventive sample was electrograined at 15V for 13 s, this was compared with sample B electrograined at 15V for 13 s.

Ranking of the samples was on the criterion whether the grained morphology of the alloy under investigation looked better, worse or the same as that of alloy B. The best rank is 1 and signifies a fully-grained topography. Rank 2 indicates where the electrograining was better than sample B. Rank 3 represents where the grained surface was the same as sample B. Rank 4 represents a topography where the surface was grained worse than sample B and Rank 5 represents situations where graining proved to be impossible.

TABLE 4

| 0.5Zn, sample 6 | Time, s | | | | | |
|---|---|---|---|---|---|---|
| Voltage, V | 10 | 11 | 12 | 13 | 14 | 15 |
| 15 | 3 | | 2 | 3 | | 3 |
| 14 | | | | | | 1 |
| 13 | | | | | | 2 |

One can see that, for the alloy with a nominal 0.5% Zn the electrograining response was the same as the reference sample B when the voltage was 15V, but there were improvements when the voltage was reduced but duration was maintained at 15 s.

TABLE 5

| 0.75Zn, sample 7 | time, s | | | | | |
|---|---|---|---|---|---|---|
| Voltage, V | 10 | 11 | 12 | 13 | 14 | 15 |
| 15 | 2 | | 3 | 1 | | 3 |
| 14 | | | | | | 1 |
| 13 | | | | | | 2 |
| 12 | 2 | | 2 | | | 2 |
| 11 | | | | | | |
| 10 | 4 | | 3 | | | 3 |

For sample 7, the increased Zn content was more readily apparent at lower voltages and shorter durations and often under a combination of both lower voltage and shorter duration.

TABLE 6

| 1Zn, sample 8 | time, s | | | | | |
|---|---|---|---|---|---|---|
| Voltage, V | 10 | 11 | 12 | 13 | 14 | 15 |
| 15 | 1 | | 1 | 1 | | 3 |
| 14 | | | | | | 1 |

TABLE 6-continued

| 1Zn, sample 8 | time, s | | | | | |
|---|---|---|---|---|---|---|
| Voltage, V | 10 | 11 | 12 | 13 | 14 | 15 |
| 13 | | | | | | 1 |
| 12 | 2 | | 2 | | | 1 |
| 11 | | | | | | |
| 10 | 2 | | 2 | | | 2 |

TABLE 7

| 1.5Zn, sample 9 | time, s | | | | | |
|---|---|---|---|---|---|---|
| Voltage, V | 10 | 11 | 12 | 13 | 14 | 15 |
| 15 | 2 | | 1 | 1 | | 3 |
| 14 | | | | | | 1 |
| 13 | | | | | | 1 |
| 12 | | | | | | 1 |
| 11 | | | | | | |
| 10 | | | | | | 1 |

Tables 6 and 7 show that the trend to increasing electrograining response was even more visible with the 1% Zn and 1.5% Zn alloys.

TABLE 8

| 2Zn, sample 10 | time, s | | | | | |
|---|---|---|---|---|---|---|
| Voltage, V | 10 | 11 | 12 | 13 | 14 | 15 |
| 15 | 1 | | 1 | 1 | | 4 |
| 14 | | | | | | 2 |
| 13 | 5 | 5 | 5 | 5 | 5 | 4 |
| 12 | 5 | 5 | 5 | 5 | 5 | 4 |

The results in Table 8 show that although the alloy containing 2% zinc did grain fully when grained at 15V for 13 secs, reducing the voltage or over-extending the duration of the treatment resulted in a worse graining response. Nevertheless, the ability to electrograin and provide a high quality surface at lower voltages for 15 s is a significant improvement and would translate into a significant operational benefit.

Samples 11-13 demonstrated localised corrosion attack along with uneven graining suggesting that alloys with zinc contents above approximately 2% are unsuitable for industrial electrograining processes. An example of the kind of surface topography established in a higher Zn sample is shown in FIG. 7.

The mechanical properties of three alloys were also measured, namely alloys B, 7 and 8. Tensile tests were performed on Instron 5565 tensile testing machine in conjunction with an Instron High Resolution Digital (HRD) extensometer. A constant speed of 0.0125 mm/s was used throughout the tests and two samples for each alloy/condition were tested. Tests were performed in accordance with European Standard EN10002-1:2001.

Alloy B, the reference sample had a yield stress of 127 MPa and a tensile strength of 141.3 MPa. Alloy 7 had a yield strength of 140.5 MPa and a tensile strength of 153.2 MPa. Alloy 8 had a yield strength of 137.9 MPa and a tensile strength of 153.4 MPa. These results show that addition of Zn results in a moderate increase in the strength of the alloy.

EXAMPLE 3

In order to assess the affect of Zn additions on alloys other than AA1050A the following experiments were conducted. In these experiments two commercial alloys were identified as the nominal base alloys. One is the alloy described within EP-A-1065071, hereinafter called 1052 and the other is the alloy known from EP-A-1341942, hereinafter called V1S. Both base alloys can be considered to be variations on the AA1050 composition and are thus classified as 1XXX series alloys for the purposes of this invention. The alloy compositions produced are listed in Table 9. Other elements present were in an amount <0.05% each and <0.15% in total.

TABLE 9

| Sample ID | Base alloy + nominal Zn (%) | Si (%) | Fe (%) | Mn (%) | Mg (%) | Zn (%) |
|---|---|---|---|---|---|---|
| C | 1052 | 0.08 | 0.30 | <0.01 | 0.100 | <0.01 |
| 14 | 1052 + 0.75Zn | 0.08 | 0.31 | 0.001 | 0.111 | 0.75 |
| 15 | 1052 + 0.75Zn | 0.08 | 0.32 | 0.001 | 0.315 | 0.75 |
| 16 | 1052 + 1.5Zn | 0.08 | 0.30 | 0.001 | 0.111 | 1.48 |
| 17 | 1052 + 1.5Zn | 0.08 | 0.33 | 0.002 | 0.315 | 1.51 |
| D | V1S | 0.08 | 0.31 | 0.118 | 0.210 | 0.002 |
| 19 | V1S + 0.75Zn | 0.08 | 0.30 | 0.050 | 0.054 | 0.75 |
| 20 | V1S + 0.75Zn | 0.08 | 0.31 | 0.053 | 0.302 | 0.75 |
| 21 | V1S + 1.5Zn | 0.08 | 0.31 | 0.052 | 0.053 | 1.51 |
| 22 | V1S + 1.5Zn | 0.08 | 0.32 | 0.054 | 0.306 | 1.50 |

Each alloy was prepared in the manner described in Example 2 and subjected to the same cleaning and electrograining conditions as described above, albeit with variations in voltage and/or duration. Again the same analysis techniques were used involving SEM observations and stereology techniques to confirm the visual observations.

Alloy D was undergrained following graining under conditions of low voltage or short time, for example 10V and/or 10 s. Increasing the zinc content to 0.75% wt produced results that were comparable to the AA1050A based alloys from earlier examples. Increasing the zinc content still further to 1.5% wt produced fully grained surfaces in the faster times and lower voltages observed with the AA1050A based alloys with similar Zn additions. With a voltage fixed at 15V, sample 19 reached a fully-grained condition after 13 s and sample 21 reached a fully grained condition after 12 s. The total charge density used under these conditions was 434.7 and 428.6 C/dm$^2$ respectively, considerably lower than the charge density needed to fully grain the reference material. When the duration of electrograining was kept constant the voltage required to achieve a fully-grained surface for alloys 19 and 21 were 14V and 12V respectively and the charge densities used were 457.8 and 431 C/dm$^2$ respectively.

The results for the 1052 based alloys also showed that for a given zinc content the graining response was entirely consistent with the 1050 based alloys from examples 1 and 2. In all cases a fully grained surface was obtained under the same conditions as those earlier examples. Alloy 17 was fully grained after 12 s at 15V and 15 s at 12V.

The full electrograining results are summarised in Table 10.

TABLE 10

| | Voltage constant @15 V | | Duration constant, 15 s | |
|---|---|---|---|---|
| Sample ID | Duration, seconds | Charge density, C/dm$^2$ | Voltage | Charge density, C/dm$^2$ |
| C | 15 | 533.3 | | |
| 14 | 13 | 424.2 | 14 | 440.7 |
| 15 | 13 | 415.7 | 14 | 452.9 |
| 16 | 12 | 413.0 | 12 | 489.4 |
| 17 | 12 | 401.3 | 12 | 406.7 |

TABLE 10-continued

| | Voltage constant @15 V | | Duration constant, 15 s | |
|---|---|---|---|---|
| Sample ID | Duration, seconds | Charge density, C/dm$^2$ | Voltage | Charge density, C/dm$^2$ |
| D | 15 | 523.5 | | |
| 19 | 13 | 434.7 | 14 | 457.8 |
| 20 | 13 | 424.2 | 13 | 401.8 |
| 21 | 12 | 428.6 | 12 | 431.0 |
| 22 | 12 | 432.5 | 10 | 435.9 |

EXAMPLE 4

To assess the impact of Zn additions on the electrograining response of alloys based on the 3XXX and 5XXX series of alloys the following experiments were carried out.

Alloy compositions as shown in Table 11 were cast in small moulds, 200 mm long, 150 mm wide and 47 mm thick. Other elements present were in an amount <0.05% each and <0.15% in total. The sides were scalped to a 35 mm thickness. These small ingots were homogenized by heating from room temperature to 520 C over 8 hrs and then held at that temperature for 5 hrs. Each small ingot was then subjected to hot and cold rolling. Cold rolling was interrupted at a gauge of 2 mm and each sheet was given an interanneal for 2 hrs at 450 C. Each sheet was then cold rolled again to a final gauge of 0.27 mm.

TABLE 11

| Sample ID | Base alloy + nominal Zn (%) | Si (%) | Fe (%) | Mn (%) | Mg (%) | Zn (%) |
|---|---|---|---|---|---|---|
| E | AA3103 + 0Zn | 0.09 | 0.51 | 1.112 | 0.101 | 0.002 |
| 24 | AA3103 + 0.75Zn | 0.08 | 0.54 | 1.089 | 0.101 | 0.75 |
| 25 | AA3103 + 1.5Zn | 0.09 | 0.55 | 01.072 | 0.101 | 1.50 |
| F | AA5005 + 0Zn | 0.14 | 0.30 | 0.024 | 0.954 | 0.003 |
| 27 | AA5005 + 0.75Zn | 0.14 | 0.31 | 0.025 | 0.964 | 0.76 |
| 28 | AA5005 + 1.5Zn | 0.15 | 0.32 | 0.003 | 1.004 | 1.52 |

Each alloy was subjected to the same cleaning and electrograining conditions as described above, albeit with variations in voltage and/or duration. Again the same analysis techniques were used involving SEM observations and stereology techniques to confirm the visual observations.

Alloy E did not grain fully under standard conditions of 15V and 15 s. Furthermore, the surface was streaky and contained black marks upon visual inspection. However, when alloy 24 with 0.75% wt zinc was grained the electrograining performance was significantly improved with much better graining topography observed. The difference between the base alloy without Zn and the base alloy containing 0.75 wt % Zn can be seen in FIGS. 8 and 9. Although fully grained surfaces were not observed under the same conditions as the AA1050A alloys, the positive influence of the zinc addition is clear.

For the 5XXX series alloys the reference alloy F did not obtain a fully grained surface under standard conditions of 15V, 15 s, (charge density 508.9 C/dm2), but performed better than alloy E. Increasing the zinc content to 0.75% wt Zn in alloy 27 resulted in a fully grained surface being obtained in 15 s at 14V and a charge density of 443.2 C/dm2, indicating the positive influence of Zn on the alloy system. Alloy 28 also reached a fully grained surface in 12 s at 15V and a charge density of 395.5 C/dm$^2$, which is comparable to the AA1050A type alloys. Again these results show that there is a positive effect of increasing the zinc content up to 1.5% wt for AA5005 base alloys.

EXAMPLE 5

In order to evaluate the electrograining performance in a nitric acid based electrolyte the following alloy compositions, in table 12, were prepared using the same process route as described in example 4. Each sample was subjected to the same caustic cleaning step as described above. Sample G is a reference sample. Other elements present were in an amount <0.05% each and <0.15% in total,

TABLE 12

| Sample ID | Base alloy + nominal Zn (%) | Si (%) | Fe (%) | Mn (%) | Mg (%) | Zn (%) |
|---|---|---|---|---|---|---|
| G | AA1050A + 0Zn | 0.09 | 0.51 | 1.112 | 0.101 | 0.002 |
| 30 | AA1050A + 1Zn | 0.08 | 0.54 | 1.089 | 0.101 | 0.75 |
| 31 | AA1050A + 1.5Zn | 0.09 | 0.55 | 01.072 | 0.101 | 1.50 |

These samples were then electrograined in a nitric acid containing electrolyte having the following composition, 7.3 g/l $HNO_3$+4.5 g/l $Al^{3+}$. The electrolyte temperature was 40° C. and the flow rate through the cell unit was 3.3 l/min.

For this electrolyte a voltage of 15V and duration of 30 s provides the conditions necessary to achieve a fully-grained surface in the AA1050A reference alloy. The charge density for the reference sample G in this nitric acid electrolyte was 496.8 C/dm$^2$. When these "standard" conditions were applied to the two Zn containing alloys the samples were also fully-grained but the average pit size was finer.

When the voltage was reduced to 13V but the duration kept at 30 s the reference sample G was not fully-grained (rolling directionality remaining visible). Conversely, the two Zn-containing alloys were fully-grained and the surface contained a finer pit size, consistent with the electrograining performance under the above standard conditions. With a voltage of 13V and duration of 30 s the charge density for both samples 30 and 31 was 438.3 C/dm$^2$.

Maintaining the voltage at 15V but reducing the duration to 25 s also produced fully-grained surfaces in the Zn-containing alloys and with a finer pit size than the reference sample. The charge density values for samples 30 and 31 under these conditions were 430.2 and 442.4 C/dm$^2$ respectively.

These results illustrate that processing efficiencies were realised when the alloys of the invention were electrograined in a nitric acid electrolyte and there was the further advantage that the electrograined surface had a finer pit size.

The invention claimed is:

1. A lithographic sheet comprising an alloy composition comprising 0.71-2.5% Zn wherein the alloy, apart from the Zn content, is an alloy from the 1XXX series of aluminum alloys.

2. The lithographic sheet of claim 1 wherein the lower Zn limit is 0.9%.

3. The lithographic sheet of claim 1 wherein the upper Zn limit is 2.0%.

4. The lithographic sheet of claim 1 wherein the upper Zn limit is 1.75%.

5. The lithographic sheet of claim 1 wherein the Zn content is 0.71-2.0%.

6. The lithographic sheet of claim 1 wherein the Zn content is 0.9-1.75%.

7. The lithographic sheet of claim 1 wherein the alloy, apart from the Zn content, is AA1050 or AA1050A.

8. The lithographic sheet of claim 1 wherein the alloy, apart from the Zn content, is in wt %; Mg 0.05 to 0.30; Mn 0.05 to 0.25; Fe 0.11 to 0.40; Si up to 0.25; Ti up to 0.03; B up to 0.01; Cu up to 0.01; and Cr up to 0.03; with unavoidable impurities up to 0.05 each and 0.15 total.

9. The lithographic sheet of claim 1 wherein the alloy, apart from the Zn content, is in wt %: Fe 0.30 to 0.40; Mg 0.10 to 0.30; Si 0.05 to 0.25; Mn up to 0.05; and Cu up to 0.04.

10. A method of producing a lithographic sheet comprising the following steps:

providing a sheet product with an electrograining surface of an aluminum alloy with a composition comprising from >0.5 to 2.5 wt % Zn wherein the alloy, apart from the Zn content, is an alloy from the 1XXX series of aluminum alloys; and electrograining the surface in an acidic electrolyte with a total charge density ≤500 C/dm$^2$.

11. The method of claim 10 wherein the total charge density used is ≤490 C/dm$^2$.

12. The method of claim 11 wherein the total charge density is ≤450 C/dm$^2$.

13. The method of claim 10 wherein the electrolyte comprises hydrochloric acid.

14. The method of claim 13 wherein the electrolyte comprises hydrochloric acid and sulphates.

15. The method of claim 10 wherein the electrolyte comprises nitric acid.

16. The method of claim 10 wherein the Zn content is 0.71-2.5%.

* * * * *